US012685414B2

(12) United States Patent
Hyun et al.

(10) Patent No.: US 12,685,414 B2
(45) Date of Patent: Jul. 21, 2026

(54) CLEANER

(71) Applicant: LG Electronics Inc., Seoul (KR)

(72) Inventors: Kietak Hyun, Seoul (KR); Hwang Kim, Seoul (KR); Jungmin Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 18/256,497

(22) PCT Filed: Aug. 27, 2021

(86) PCT No.: PCT/KR2021/011493
§ 371 (c)(1),
(2) Date: Jun. 8, 2023

(87) PCT Pub. No.: WO2022/124528
PCT Pub. Date: Jun. 16, 2022

(65) Prior Publication Data

US 2024/0023768 A1 Jan. 25, 2024

(30) Foreign Application Priority Data

Dec. 9, 2020 (KR) ..... 10-2020-0171496

(51) Int. Cl.
*A47L 5/24* (2006.01)
*A47L 9/10* (2006.01)
*A47L 9/16* (2006.01)

(52) U.S. Cl.
CPC ..... *A47L 5/24* (2013.01); *A47L 9/108* (2013.01); *A47L 9/1616* (2013.01); *A47L 9/1666* (2013.01); *A47L 9/1683* (2013.01)

(58) Field of Classification Search
CPC ..... A47L 9/108; A47L 9/1616; A47L 9/1666; A47L 9/1683; A47L 9/106; A47L 5/24
See application file for complete search history.

(56) References Cited

U.S. PATENT DOCUMENTS 7,175,682 B2 * 2/2007 Nakai ..... A47L 9/20 15/352
9,009,914 B2 * 4/2015 Tran ..... A47L 9/325 55/459.1

(Continued)

FOREIGN PATENT DOCUMENTS

CN 101103888 A * 1/2008 ..... A47L 9/1683
CN 201299516 9/2009

(Continued)

OTHER PUBLICATIONS

CN-101103888 Espacenet Translation; Dust Container; Haan, Gyung-Hee; Jan. 16, 2008 (Year: 2008).*

(Continued)

*Primary Examiner* — Monica S Carter
*Assistant Examiner* — Sidney D Full
(74) *Attorney, Agent, or Firm* — Fish & Richardson P.C.

(57) ABSTRACT

A cleaner includes a dustbin having an inlet formed on a first side thereof and an outlet formed on a second side thereof, the dustbin being provided with a cyclone part generating a cyclonic flow inside the cyclone part, and a motor part configured to communicate with the dustbin and generate a flow of air inside the dustbin. The dustbin includes a casing having the inlet and the outlet formed thereon, a separating wall dividing an inner space of the casing, a first dust storage part located in the inner space and communicating with the inlet, a first cap, a second dust storage part located in the inner space and communicating with the outlet, a second cap, and a lever.

15 Claims, 12 Drawing Sheets

(56) References Cited

U.S. PATENT DOCUMENTS

| | | | | |
|---|---|---|---|---|
| 2005/0223518 | A1 | 10/2005 | Nakai et al. | |
| 2006/0090428 | A1 | 5/2006 | Park et al. | |
| 2012/0047682 | A1* | 3/2012 | Makarov | A47L 9/1666 15/347 |
| 2016/0088988 | A1* | 3/2016 | Eo | A47L 9/1691 55/343 |
| 2019/0038097 | A1* | 2/2019 | Cho | A47L 9/165 |
| 2020/0029759 | A1 | 1/2020 | Conrad | |

FOREIGN PATENT DOCUMENTS

| | | | | |
|---|---|---|---|---|
| CN | 201299516 | Y | * | 9/2009 |
| GB | 2447098 | A | | 9/2008 |
| KR | 10-0572882 | | | 4/2006 |
| KR | 10-2007-0041233 | | | 4/2007 |
| KR | 10-1411705 | | | 7/2014 |
| WO | 2000/074548 | A1 | | 12/2000 |

OTHER PUBLICATIONS

CN 201299516 Espacenet Translation; Cyclone Separator for Vacuum Cleaner; JIANG, Yi-bang; Sep. 2, 2009 (Year: 2009).*

International Search Report and Written Opinion in International Appln. No. PCT/KR2021/011493, mailed on Dec. 16, 2022, 20 pages (with English translation).

Extended European Search Report in European Appln. No. 21903575.5, mailed on May 26, 2025, 5 pages.

Office Action in Korean Appln. No. 10-2020-0171496, mailed on Dec. 16, 2025, 18 pages (with English translation).

* cited by examiner

CLEANER

CROSS-REFERENCE TO RELATED APPLICATIONS

This application is a National Stage application under 35 U.S.C. § 371 of International Application No. PCT/KR2021/011493, filed on Aug. 27, 2021, which claims the benefit of Korean Application No. 10-2020-0171496, filed on Dec. 9, 2020.

TECHNICAL FIELD

The present disclosure relates generally to a cleaner and, more particularly, to a vacuum cleaner in which a longitudinal axis of a suction part and a cyclonic flow axis are arranged to be perpendicular to each other.

BACKGROUND ART

In general, a cleaner is a home appliance that sucks up small debris or dust by sucking air by using electricity so that the same is filled in a dust bin in the product, and is commonly referred to as a vacuum cleaner.

Such a cleaner may be classified into a manual cleaner by which a user performs cleaning while directly moving the cleaner, and an automatic cleaner which performs cleaning while driving by itself. A manual cleaner may be classified into a canister vacuum cleaner, an upright vacuum cleaner, a hand vacuum cleaner, and a stick vacuum cleaner according to the shape of a cleaner.

Among household cleaners, a canister vacuum cleaner has been widely used in the past, but recently, a hand vacuum cleaner and a stick vacuum cleaner, in which a dustbin and a main body are provided integrally to improve usability, are becoming more popular.

In a canister vacuum cleaner, a main body and a suction port are connected to each other by a rubber hose or pipe, and in some cases, a brush is fitted in the suction port.

A hand vacuum cleaner, which maximizes portability, is light in weight, but short in length, so the cleaner may be limited to a cleaning area in which a user sits and cleans. Accordingly, the hand vacuum cleaner is used to clean localized areas, such as on a desk or sofa, or is used in a car.

A stick vacuum cleaner can be used standing up, so a user can clean without bending down. Accordingly, the stick vacuum cleaner is advantageous for a user to clean a large area while moving. A hand vacuum cleaner may be used to clean a small space, whereas the stick vacuum cleaner may be used to clean a larger space and hard-to-reach high areas. Recently, a stick vacuum cleaner is provided as a module type, and a cleaner type thereof is actively changed and used for various objects.

As a prior art for a hand or stick vacuum cleaner, there is a vacuum cleaner equipped with a cyclone separator. The cleaner of the prior art is provided with a cylindrical dustbin having a vertical axis, wherein a plurality of cyclone parts having vertical axes is disposed inside the dustbin. Air introduced into the dustbin is separated from dust by the cyclone parts, and the separated dust is collected in the lower part of the dustbin.

According to the prior art, dust of various sizes is collected in the dustbin. However, relatively large dust may be easily discharged by gravity, whereas relatively fine dust settles in the dustbin and is not easily discharged by gravity. Furthermore, fine dust is easily scattered even by a slight wind, and thus is required to be carefully handled. According to the prior art, despite careful handling, dust of various sizes is mixed in one dustbin, and thus fine dust remains in the dustbin or is scattered without being thrown into a trash can.

Meanwhile, relatively large dust occupies a large volume in the dustbin. The large dust may have a very small volume by being compressed and may occupy less space during processing. However, since a cleaner of the prior art does not include a compression member, the cleaner also has a problem in that the cleaner does not compress the dust to efficiently utilize space.

DISCLOSURE

Technical Problem

Accordingly, the present disclosure is intended to propose a cleaner which to prevent scattering of fine dust, separately collects sucked dust by classifying the dust according to size and separately discards the collected dust according to size.

The present disclosure is further intended to propose a cleaner which is provided with a compression member that reduces the volume of dust by compressing the dust collected in the dustbin in order to collect more dust within a limited capacity of a dustbin.

The objectives of the present disclosure are not limited to the objectives mentioned above, and other objectives not mentioned will be clearly understood by those skilled in the art from the following description.

Technical Solution

In order to achieve the above objectives, a cleaner according to an embodiment of the present disclosure includes: a dustbin having an inlet formed on a first side thereof and an outlet formed on a second side thereof, the dustbin being provided with a cyclone part generating a cyclonic flow inside the cyclone part; and a motor part configured to communicate with the dustbin and generate a flow of air inside the dustbin. The dustbin includes: a casing having the inlet and the outlet formed thereon; a separating wall dividing an inner space of the casing; a first dust storage part located in the inner space and communicating with the inlet, with a first opening part formed on one side of the first dust storage part; a first cap configured to cover the first opening part; a second dust storage part located in the inner space and communicating with the outlet, with a second opening part formed on one side of the second dust storage part; a second cap configured to cover the second opening part; and a lever configured to selectively open the first cap or the second cap.

The first opening part may be formed on a first side of the casing, and the second opening part may be formed on a second side of the casing and face the first opening part.

At least any one of the first cap and the second cap may include a hinge connected to the casing at a first end thereof, and a hook selectively fastened to the casing at a second end thereof.

The first cap may include a first cap hook fastened to the casing, and the second cap may include a second cap hook fastened to the casing, wherein the first cap hook and the second cap hook may be arranged on a straight line with a rail.

The first cap may include the first cap hook fastened to the casing, and the second cap may include the second cap hook fastened to the casing, wherein the first cap hook and the second cap hook may be disposed at opposite sides of a rail relative to the rail.

The second cap may include the second cap hook fastened to the casing, and the casing may include a second cap protrusion formed on one side of an outer circumferential surface thereof and configured to hold the second cap hook.

The casing may further include a second release protrusion which is disposed between the second cap protrusion and the lever and protrudes upward.

The cleaner may include: a second elastic member which provides a restoring force to the lever when the lever moves in a first direction; and a first elastic member which provides a restoring force to the lever when the lever moves in a second direction.

The lever may have an inner space, and the casing may include an elastic member support protrusion protruding to the inner space of the lever, wherein the first elastic member may be supported by a first side of the elastic member support protrusion, and the second elastic member may be supported by a second side of the elastic member support protrusion.

The cleaner may include: a compression plate disposed in the first cap and configured to reciprocate in the first dust storage part.

The cleaner may include: a rail protruding outward from an outer circumferential surface of the casing and extending toward at least any one of the first opening part and the second opening part, with at least a portion of the rail covered by the lever.

Other details of the embodiment are included in the detailed description and drawings.

Advantageous Effects

The cleaner according to the present disclosure has one or more of the following effects.

First, based on the separating wall, larger dust is collected in the first dust storage part, and smaller dust is collected in the second dust storage part, and thus dust is collected by being separated by size, thereby preventing the scattering of fine dust.

Second, the lever moves in the first direction X to open the first cap or moves in the second direction Y to open the second cap so as to selectively open and close the first cap or the second cap, thereby enabling large dust and fine dust to be separated and discarded in order so that the dust can be discharged easily and cleanly.

Third, when the lever moves in the second direction Y, the second cap is opened and large dust present in the first dust storage part is compressed, and thus even if the first dust storage part is not opened, the large dust present in the first dust storage part is easily compressed, thereby enabling more dust to be collected in a limited space.

The effects of the present disclosure are not limited to the effects mentioned above, and other effects not mentioned will be clearly understood by those skilled in the art from the description of the claims.

BEST MODE

Figure 1:
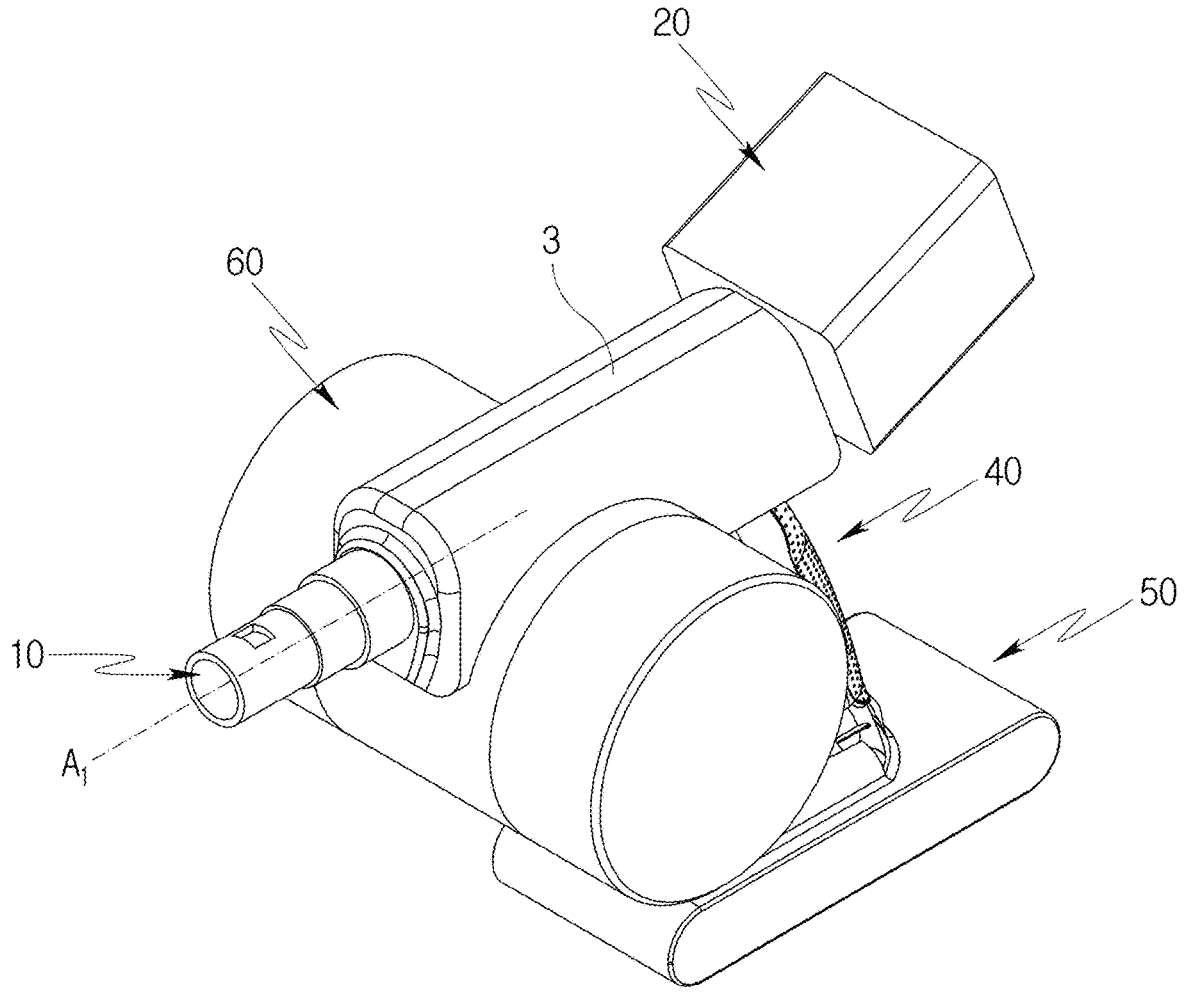
FIG. 1 is a perspective view of a cleaner according to an embodiment of the present disclosure.

Hereinafter, an exemplary embodiment of the present disclosure will be described in detail with reference to the accompanying drawings.

Since the present disclosure may make various changes and have various embodiments, the specific embodiment will be illustrated in the drawings and described in detail in the detailed description. This is not intended to limit the present disclosure to the specific embodiment, and should be construed as including all modifications, equivalents, or substitutes included in the spirit and technical scope of the present disclosure.

In describing the present disclosure, terms such as first and second may be used to describe various components, but the components may not be limited by the terms. The terms are only for the purpose of distinguishing one component from another. For example, a first element may be termed a second element, and similarly, the second element may be termed the first element, without departing from the scope of the present disclosure.

A term "and/or" may include any combination of a plurality of related listed items or any of a plurality of related listed items.

It will be understood that when an element is referred to as being "coupled" or "connected" to another element, it may be directly coupled or connected to the other element or intervening elements may be present therebetween. On the other hand, it should be understood that when an element is referred to as being "directly coupled" or "directly connected" to another element, there are no intervening elements present.

Terms used in this application are only used to describe the specific embodiment, and are not intended to limit the present disclosure. Singular expressions may include plural expressions unless the context clearly dictates otherwise.

In this application, terms such as "include" or "have" are intended to designate the presence of features, numbers, steps, operations, components, parts, or combinations thereof described in the specification, and may be understood not to exclude in advance the presence or addition of one or more other features, numbers, steps, operations, components, parts, or combinations thereof.

Unless defined otherwise, all terms used herein, including technical or scientific terms, may have the same meaning as commonly understood by those skilled in the art to which the present disclosure belongs. Terms such as those defined in commonly used dictionaries may be interpreted as having a meaning consistent with the meaning in the context of the related art, and may not be interpreted to have an ideal or excessively formal meaning unless explicitly defined in the present application.

In addition, the following embodiment is provided to more completely explain to those with average knowledge in the art, and the shapes and sizes of elements in the drawings may be exaggerated for clearer explanation.

Figure 2:
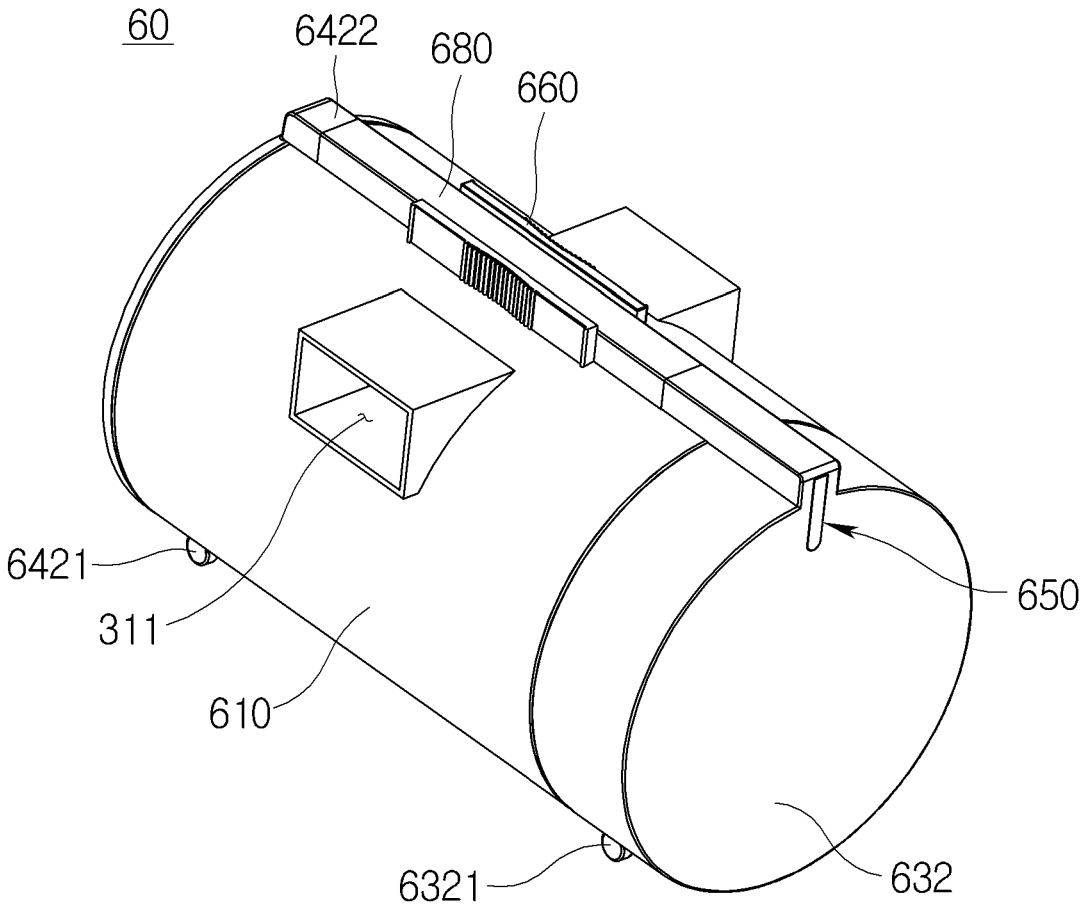
FIG. 2 is a perspective view of a dustbin according to the embodiment of the present disclosure.
Figure 3:
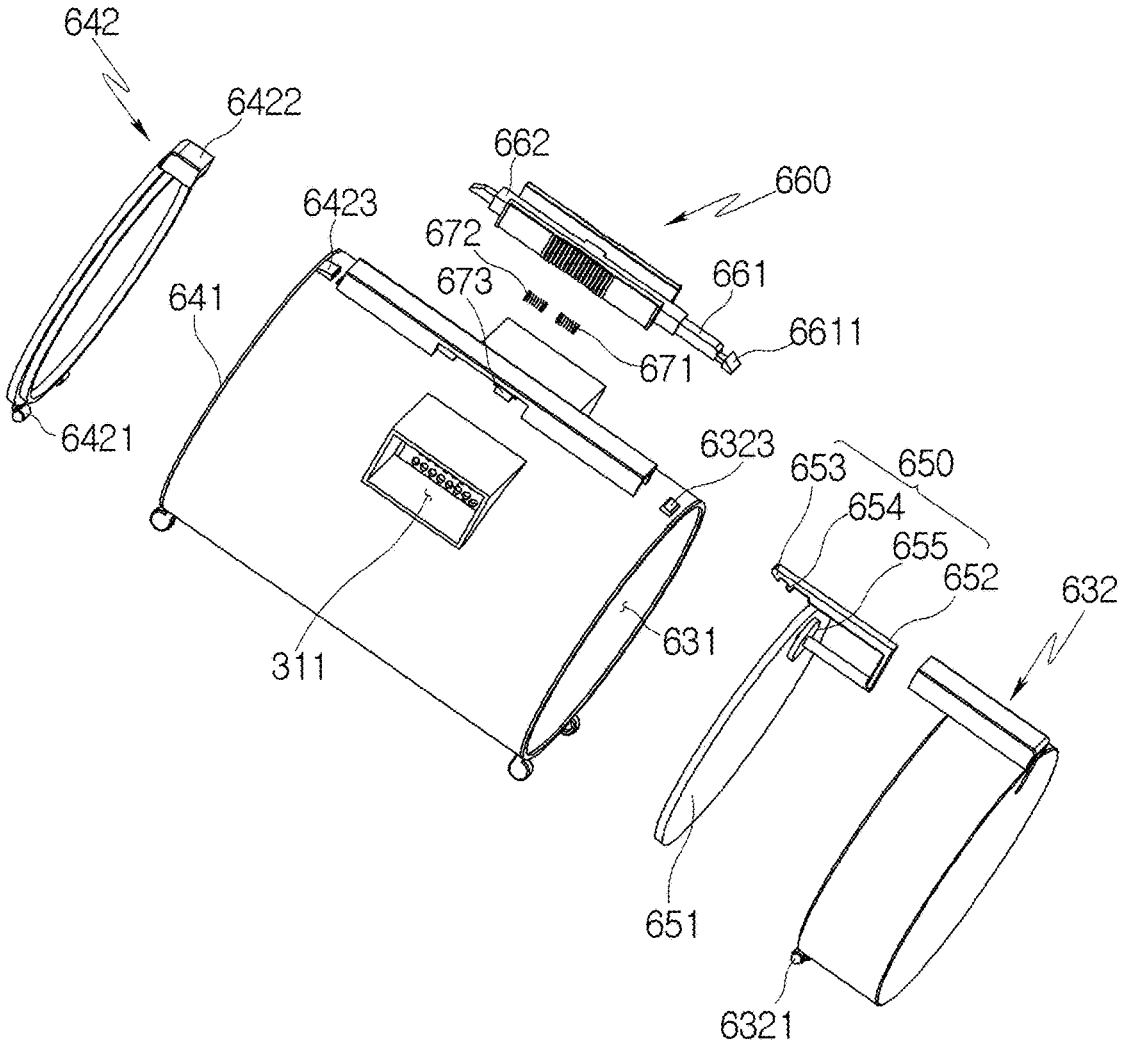
FIG. 3 is an exploded perspective view of the dustbin according to the embodiment of the present disclosure.
Figure 4:
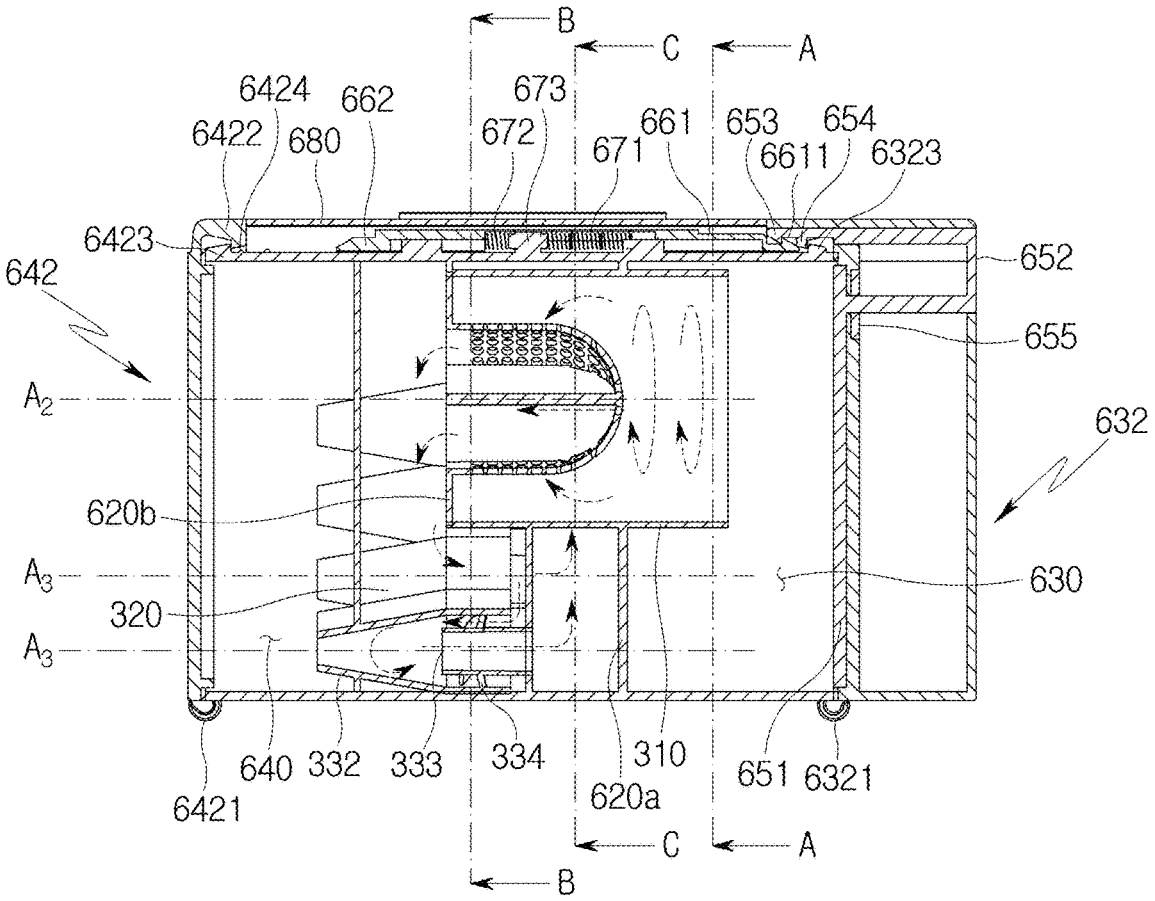
FIG. 4 is a cross-sectional view of the dustbin of FIG. 3 viewed from the front.

FIG. 1 is a perspective view of a cleaner 1 according to the embodiment of the present disclosure, FIG. 2 is a perspective view of a dustbin 60 according to the embodiment of the present disclosure, FIG. 3 is an exploded perspective view of the dustbin 60 according to the embodiment of the present disclosure, and FIG. 4 is a cross-sectional view of the dustbin 60 of FIG. 3 viewed from the front.

Referring to FIGS. 1 to 4, the cleaner 1 according to the embodiment of the present disclosure may include a main body 2. The main body 2 may include a suction part 10 through which air including dust is sucked.

Based on the longitudinal axis A1 of the suction part 10, a first side at which the suction part 10 is located is defined to as a front side, and a second side at which a motor part 20 to be described later is located is defined as a rear side. Based on the main body 2 illustrated in FIG. 1, an upper side of the main body 2 is defined as an upper side, and a lower side thereof is defined as a lower side.

The exterior of the main body 2 is constituted by a housing 3.

A handle 40 is formed on the housing 3.

The suction part 10 is coupled to the front of the housing 3.

The dustbin 60 is coupled to the front of the housing 3. An opening part is formed in a portion in which the housing 3 is coupled to the dustbin 60, and the housing 3 and the dustbin 60 communicate with each other.

A power supply part 50 is coupled to the lower part of the housing 3.

The motor part 20 is coupled to the upper part of the housing 3. The motor part 20 may be coupled to the rear upper part of the housing 3.

The suction part 10, which has a cylindrical shape with an open interior, is a component through which air including dust is sucked, and may provide a suction passage through which air including dust can flow. Air including dust may be guided to the main body 2 through the suction part 10.

The suction part 10 communicates with an inlet 311 of a cyclone part 30. Air sucked in from a nozzle passes through the suction part 10 and is introduced through the inlet 311 to the cyclone part 30.

The main body 2 may further include the motor part 20, the cyclone part 30, the handle 40, and the power supply part 50.

Here, the motor part 20 is a component that generates an air flow (i.e., an air current) so that air including dust can flow into the suction part 10. The motor part 20 may include a motor housing and a suction motor (not shown) accommodated inside the motor housing.

The suction motor (not shown) may include a motor shaft (not shown) and an impeller which is connected to the motor shaft and rotates.

The suction motor (not shown) may be a brushless DC (BLDC) motor. The BLDC motor is a DC motor of a brushless type. The BLDC motor does not have brushes, which are abrasive parts, so the BLDC motor has the advantages that the motor is low in electrical and mechanical noise, has no problem in high-speed rotation, and is low in rotation noise.

The motor part 20 is disposed on the longitudinal axis A1 of the suction part. The center of gravity of the motor part 20 is disposed on the longitudinal axis A1 of the suction part.

By having this arrangement, moment generated in the cleaner 1 may be minimized. In more detail, the main body 2 of the cleaner may be defined as a rigid body. Air is introduced biasedly to an upper side of the main body 2 relative to the main body 2 of the cleaner. In this case, when an outlet is formed at a position which does not correspond to a position at which air is introduced, moment is generated since an air inflow direction and the air discharge direction are different, which may result in a unidirectional rotation of the cleaner. As a result, a user may feel uncomfortable when manipulating the cleaner 1. However, in the cleaner 1 according to the present disclosure, the motor part 20 is disposed on the longitudinal axis A1 of the suction part, thereby minimizing moment generated in the cleaner 1, and facilitating the manipulation of the cleaner 1.

The main body 2 may further include the dustbin 60 for storing dust separated from the cyclone part 30.

The dustbin 60 has the inlet 311 formed at a first side thereof and the outlet 331 formed at a second side thereof. The dustbin 60 has the cyclone part 30 generating a cyclonic flow inside.

The dustbin 60 includes a casing 610 having a cylindrical shape. The casing 610 has the inlet 311 through which air is introduced into the dustbin 60, and the outlet 331 through which air is discharged to the outside of the dustbin 60.

Referring to FIG. 2, the inlet 311 is formed toward the front side of the dustbin 60, and the outlet 331 is formed toward the rear side of the dustbin 60.

The inlet 311 and the outlet 331 are formed in the circumferential direction of the dustbin 60. The inlet 311 introduces dust in the circumferential direction of the dustbin 60, and the introduced dust flows cyclonically along the inner circumferential surface of the dustbin 60 or the outer circumferential surface of a cyclone filter 350.

The longitudinal axis of the inlet 311 and the longitudinal axis of the outlet 331 may constitute a coaxial axis. The coaxial axis is defined as a straight line A1 passing through the inlet and the outlet. The straight line passing through the inlet and the outlet 331 may be coaxial with the longitudinal axis A1 of the suction part.

The inner space of the casing 610 is divided into a first dust storage part 630 and a second dust storage part 640 by a separating wall 620.

The first dust storage part 630 is one of the inner spaces of the casing 610 and communicates with the inlet 311.

Referring to FIG. 2, the first dust storage part 630 is formed on the right side of the separating wall 620. A first cyclone 310 is disposed in the first dust storage part 630, and first separates relatively large dust in air introduced from the inlet 311.

The first dust storage part 630 may be formed in a cylindrical shape.

The first dust storage part 630 is closed at a first end thereof by a separation plate and has a first opening part 631 formed at a second end thereof. Dust settled in the first dust storage part 630 is discharged through the first opening part 631 to the outside.

A first cap 632 is rotatably disposed in the first opening part 631 of the first dust storage part 630. During operation of the cleaner 1, the first cap 632 closes the first opening part 631. After the cleaner 1 is operated, the first cap 632 opens the first opening part 631 so that dust settled in the first dust storage part 630 can be removed.

The first cap 632 is a component that selectively opens and closes the first opening part 631. The first cap 632 covers the first opening part 631.

The first cap 632 has a hinge disposed on a first side thereof, and a hook disposed on a second side thereof. Referring to FIG. 3, the first cap hinge 6321 is disposed on the lower end of the first cap 632. The first cap 632 rotates relative to the first cap hinge 6321 to open and close the first opening part 631. Referring to FIG. 3, a first cap hook 653 is disposed on the upper end of the first cap 632. When the first cap hook 653 is held by a first cap protrusion 6323, the first cap 632 is fixed while closing the first opening part 631. The holding of the first cap hook 653 is released by a lever 660.

The compression member 650 may be disposed on the first cap 632. The compression member 650 will be described later.

The second dust storage part 640 is one of the inner spaces of the casing 610 and communicates with the outlet 331. Referring to FIG. 2, the second dust storage part 640 is formed on the left side of the separation plate. A second cyclone 330 is disposed in the second dust storage part 640 and secondly separates relatively fine dust in air introduced from the inlet 311.

The second dust storage part 640 may be formed in a cylindrical shape.

The second dust storage part 640 is closed at a first end thereof by the separation plate and has a second opening part 641 formed at a second end thereof. Dust settled in the second dust storage part 640 is discharged through the second opening part 641 to the outside.

A second cap 642 is a component that selectively opens and closes the second opening part 641. The second cap 642 covers the second opening part 641.

The second cap 642 has a hinge disposed on a first side thereof, and a hook disposed on a second side thereof. Referring to FIG. 3, a second cap hinge 6421 is disposed on the lower end of the second cap 642. The second cap 642 rotates relative to the second cap hinge 6421 to open and close the second opening part 641. Referring to FIG. 3, a second cap hook 6422 is disposed on the upper end of the second cap 642. When the second cap hook 6422 is held by a second cap protrusion 6423, the second cap 642 is fixed while closing the second opening part 641. The holding of the second cap hook 6422 is released by the lever 660.

The first opening part 631 and the second opening part 641 face each other. Referring to FIG. 2, the first opening part 631 is formed on the right end of the casing 610, and the second opening part 641 is formed on the left end of the casing 610. By spatially separating the first opening part 631 and the second opening part 641 from each other, larger dust and smaller dust may be discharged separately.

The separating wall 620 is a component that divides the inner space of the dustbin 60 into the first dust storage part 630 and the second dust storage part 640. At least a portion of the first cyclone 310 passes through the separating wall 620. The separating wall 620 is composed of a first separating wall 620*a* and a second separating wall 620*b*.

The first separating wall 620*a* extends radially outward from the outer circumferential surface of the first cyclone 310, and the second separating wall 620*b* extends radially inward from the inner circumferential surface of the first cyclone 310. The second separating wall 620*b* may extend radially outward from the outer circumferential surface of the first cyclone 310.

The first separating wall 620*a* extends radially outward from the side of the first cyclone 310. The first separating wall 620*a* separates the first dust storage part 630 from the second dust storage part 640.

The second separating wall 620*b* extends radially inward or radially outward from an end part of the first cyclone 310. The second separating wall 620*b* closes one end of the first cyclone 310.

At least a portion of the first cyclone 310 is inserted into the first separating wall 620*a*. The first cyclone 310 is closed at one side thereof by the second separating wall 620*b*.

The first cyclone 310 is disposed to be spaced apart from the dustbin 60. The separating wall 620 is supported by the dustbin 60 and supports the first cyclone 310.

The separating wall 620 separates the inner space of the casing 610 so that the first dust storage part is disposed at a first side relative to the straight line A1 passing through the inlet and the outlet and the second dust storage part 640 is disposed at a second side relative to the straight line A1. The straight line A1 passing through the inlet and the outlet is coaxial with the longitudinal axis A1 of the suction part. By having this arrangement, the first dust storage part 630 and the second dust storage part 640 are disposed in spaces spaced apart from each other on the opposite sides of an incoming air flow so that large dust and small dust can be easily stored in different spaces.

The separating wall 620 is arranged parallel to the air inflow direction at the inlet 311. In other words, the separating wall 620 is arranged parallel to the straight line A1 passing through the inlet and the outlet. When viewed from the front side, the separating wall 620 separates the first dust storage part 630 and the second dust storage part 640 arranged at right and left sides, respectively. By having such arrangement, large dust and small dust may be easily stored in different spaces at the opposite sides of the flow of incoming air.

The separating wall 620 is disposed perpendicularly to a first cyclonic flow axis A2 or a second cyclonic flow axis A3. In other words, the separating wall 620 extends in a front-to-rear direction.

Referring to FIG. 4, the separating wall 620 includes a communication hole 621. The communication hole 621 allows the first dust storage part 630 and the second dust storage part 640 to communicate with each other.

The communication hole 621 is formed through a side of the separating wall 620. The communication hole 621 is disposed inside the first cyclone 310.

The communication hole 621 is disposed on the upper side of the separating wall 620. Referring to FIG. 4, the communication hole 621 is disposed on the upper side, and the first cyclone 310 is also disposed on the upper side of the separating wall 620. The first cyclone 310 covers the communication hole 621.

When the separating wall 620 is divided into the first separating wall 620*a* and the second separating wall 620*b*, the communication hole 621 is formed in the second separating wall 620*b*.

The cyclone filter 350 is disposed in the communication hole 621.

The cyclone part 30 communicates with the suction part 10, and is a component to which the principle of a dust collector using centrifugal force is applied so as to separate dust sucked into the main body 2 through the suction part 10.

For example, the cyclone part 30 may include the first cyclone 310 capable of separating dust by a cyclonic flow. The first cyclone 310 may communicate with the suction part 10. Air and dust sucked through the suction part 10 spirally flow along the inner circumferential surface of the first cyclone 310. The cyclonic flow axis A2 of the first cyclone 310 may extend left and right.

The cyclone part 30 may further include the second cyclone 330 for re-separating dust from air discharged from the first cyclone 310. The second cyclone 330 may include multiple cyclone bodies arranged in parallel. The air discharged from the first cyclone 310 may be divided to pass through the multiple cyclone bodies.

In this case, the cyclonic flow axis A3 of the second cyclone 330 may also extend to left and right sides, and the cyclonic flow axis A2 of the first cyclone 310 and the cyclonic flow axis A3 of the second cyclone 330 are arranged in parallel to each other.

The cyclonic flow axes A2 and A3 may be disposed perpendicularly to the longitudinal axis A1 of the suction part. More specifically, the cyclonic flow axes A2 and A3 may be disposed perpendicularly to both the longitudinal axis A1 of the suction part and the longitudinal axis A4 of the handle. Referring to FIG. 4, the cyclonic flow axes A2 and A3 are disposed perpendicularly to the longitudinal axis A1 of the suction part, and are disposed parallel to the ground. Accordingly, sucked air flows rearward along the longitudinal axis A1 of the suction part and is introduced into the cyclone part 30 in a direction perpendicular to the cyclonic flow axis A3.

The cyclone part 30 is disposed on the lower side of the suction part 10. Dust of various sizes is included in the suction part 10. When the cyclone part 30 is disposed on the upper side of the suction part 10, very large dust may be settled between the cyclone part 30 and the suction part 10, and remain between the cyclone part 30 and the suction part 10 without joining a cyclonic flow. Accordingly, the cyclone part 30 is disposed on the lower side of the suction part 10 so that dust is efficiently introduced into the cyclone part 30.

The first cyclone 310 and the second cyclone 330 are disposed in spaces spaced apart from each other with the separating wall 620 placed between the first cyclone 310 and the second cyclone 330.

When viewed from the front side, the first cyclone 31 is disposed at the right side of the separating wall 620. The first cyclone 310 is disposed in the first dust storage part 630.

The first cyclone 310 is formed in a cylindrical shape. The first cyclone 310 is formed in a cylindrical shape centered on the first cyclonic flow axis A2. The first cyclonic flow axis A2 is parallel to the central axis of the dustbin 60.

The first cyclonic flow axis A2 is disposed in left and right directions. In more detail, the first cyclonic flow axis A2 is formed parallel to the ground. Accordingly, introduced air orbits along the first cyclonic flow axis A2, and dust of the air accumulates on the bottom of the first cyclone 310.

The inlet 311 is formed on one side of the first cyclone 310. The inlet 311 allows the suction part 10 and the first cyclone 310 to connect with each other. The front end of the inlet 311 communicates with the suction part 10, and the rear end of the inlet 311 communicates with the first cyclone 310.

The inlet 311 is disposed on one side of the first cyclone 310. More specifically, referring to FIG. 5, the inlet 311 is formed on the outer circumferential surface of the first cyclone 310. The inlet 311 is formed in the circumferential direction of the first cyclone 310 and introduces air into the first cyclone 310 in the circumferential direction. Accordingly, the air introduced into the first cyclone 310 flows cyclonically along the first cyclonic flow axis A2.

At least a portion of the first cyclone 310 is disposed through the separating wall 620. In other words, the separating wall 620 extends outward from the outer circumferential surface of the first cyclone 310. Since at least a portion of the first cyclone 310 passes through the separating wall 620, the stroke distance of a compression plate 651 may be further increased, and large dust present inside the first dust storage part 630 may be compressed more.

The first cyclone 310 is disposed at the upper side of the first dust storage part 630. Accordingly, dust accumulates in the lower space of the first cyclone 310.

The inlet 311 is disposed in the radial direction of the longitudinal axis A1 of the suction part and is disposed in the radial direction of the cyclonic flow axis. In other words, the inlet 311 is disposed at the intersection of the longitudinal axis A1 of the suction part and the cyclonic flow axis.

The first cyclonic flow axis A2 intersects with the longitudinal axis A1 of the suction part and is perpendicular to the longitudinal axis A4 of the handle. More specifically, the first cyclonic flow axis A2 is perpendicular to both the longitudinal axis A1 of the suction part and the longitudinal axis A4 of the handle.

The inlet 311 is placed on the longitudinal axis A1 of the suction part. Due to this arrangement, air is introduced into the first cyclone 310 with minimal resistance. Accordingly, an active cyclonic flow may be generated inside the first cyclone 310.

Inside the first cyclone 310, air rotates along the circumference of the cyclone filter 350.

The first cyclone 310 is closed at one side and is open at another side. Referring to FIG. 4, the left end of the first cyclone 310 is closed by the second separating wall **620*b*, and the right end of the first cyclone 310 is open. The second separating wall 620*b* has the communication hole 621, through which air present in the first cyclone 310 flows to the second cyclone 330. The open part of the first cyclone 310 communicates with the first dust storage part 630, and dust settled on the bottom of the first cyclone 310 falls to the first dust storage part 630** by gravity.

The first cyclonic flow axis A2 intersects with the longitudinal axis A1 of the suction part. More specifically, the first cyclonic flow axis A2 is perpendicular to the longitudinal axis A1 of the suction part and is parallel to the ground. In other words, the first cyclonic flow axis A2 is perpendicular to a straight line passing through the inlet 311 and the outlet. The longitudinal axis A1 of the suction part corresponds to the circumferential direction of the first cyclone 310. Accordingly, dust introduced from the suction part 10 flows cyclonically inside the first cyclone 310. The dust may be rapidly separated from air due to centrifugal force and gravitational force caused by the cyclonic flow.

The cyclone part 30 is disposed at the lower side of the suction part 10.

When viewed from the front side, the second cyclone 330 is disposed at the left side of the separating wall 620. The second cyclone 330 is disposed in the second dust storage part 640.

The second cyclone 330 is formed in a cylindrical shape. The second cyclone 330 is formed in a cylindrical shape centered on the second cyclonic flow axis A3. The second cyclonic flow axis A3 is parallel to the central axis of the dustbin 60.

The second cyclone consists of an outer tube 332 and an inner tube 333. The cyclonic flow of the second cyclone 330 is generated between the outer tube 332 and the inner tube 333.

Referring to FIG. 4, a gap is formed between the outer tube 332 and the inner tube 333 of the second cyclone 330.

Air passing through the cyclone filter 350 is introduced into the gap between the outer tube 332 and the inner tube 333 of the second cyclone 330.

An end part of the outer tube 332 may be formed in a cone shape with a diameter decreasing gradually.

The second cyclone 330 includes a blade 334. The blade 334 helps generate a cyclonic flow in the second cyclone 330.

The blade 334 is formed between the outer tube 332 and the inner tube 333 of the second cyclone 330. The blade 334 generates a vortex in one direction. When viewed from the left side, the blade 334 may generate a cyclonic flow in a counterclockwise direction.

Dust may be rapidly separated from air due to centrifugal force and gravitational force caused by a cyclonic flow.

Air flows cyclonically in space between the outer tube 332 and the inner tube 333. The air flowing cyclonically may be discharged through the inner tube 333 to the outside. Referring to FIG. 4, dust is separated to the left side of the second cyclone 330, and air flows to the right side of the second cyclone 330.

A plurality of second cyclones 330 is disposed along the outer circumferential surface of the first cyclone 310. Referring to FIG. 4, the second cyclones 330 are disposed at the left side, lower side, and right side of the first cyclone 310. Air introduced into the second dust storage part 640 from the cyclone filter 350 has a rotating flow, and by having such arrangement, the air may be equally introduced into each of the second cyclones 330.

The second cyclonic flow axis A3 is disposed in left and right directions. In more detail, the second cyclonic flow axis A3 is formed parallel to the ground. Accordingly, introduced air orbits along the second cyclonic flow axis A3, and dust of the air is settled on the bottom of the second cyclone 330.

The outlet 331 is formed on one side of the second dust storage part 640. The front end of the outlet 331 communicates with the second dust storage part 640, and the rear end of the outlet 331 communicates with the housing 3 or the motor part 20.

The outlet 331 is formed on the outer circumferential surface of the dustbin 60 and discharges air to the outside from a circumferential direction thereof.

The air discharge direction of the outlet 331 may be parallel to the air inflow direction of the inlet 311. In more detail, the air discharge direction of the outlet 331 may be coaxial with the air inflow direction of the inlet 311.

The second cyclonic flow axis A3 is perpendicular to the longitudinal axis A1 of the suction part and is parallel to the ground. In other words, the second cyclonic flow axis A3 is perpendicular to the straight line A1 passing through the inlet and the outlet.

The second cyclonic flow axis A3 intersects with the longitudinal axis A1 of the suction part and is perpendicular to the longitudinal axis A4 of the handle. More specifically, the second cyclonic flow axis A3 is perpendicular to both the longitudinal axis A1 of the suction part and the longitudinal axis A4 of the handle.

Figure 5:
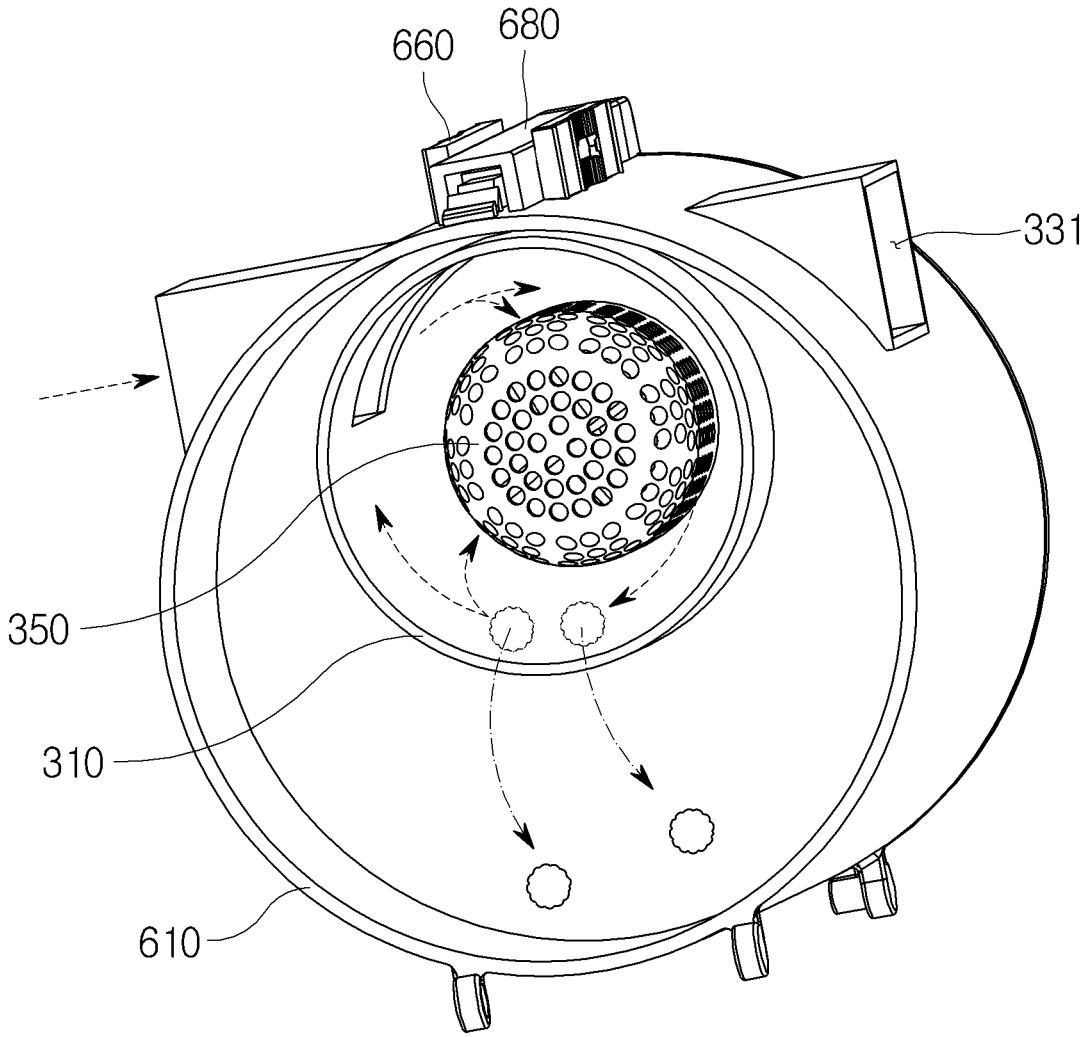
FIG. 5 is an A directional cross-sectional view of the dustbin in FIG. 4.
Figure 6:
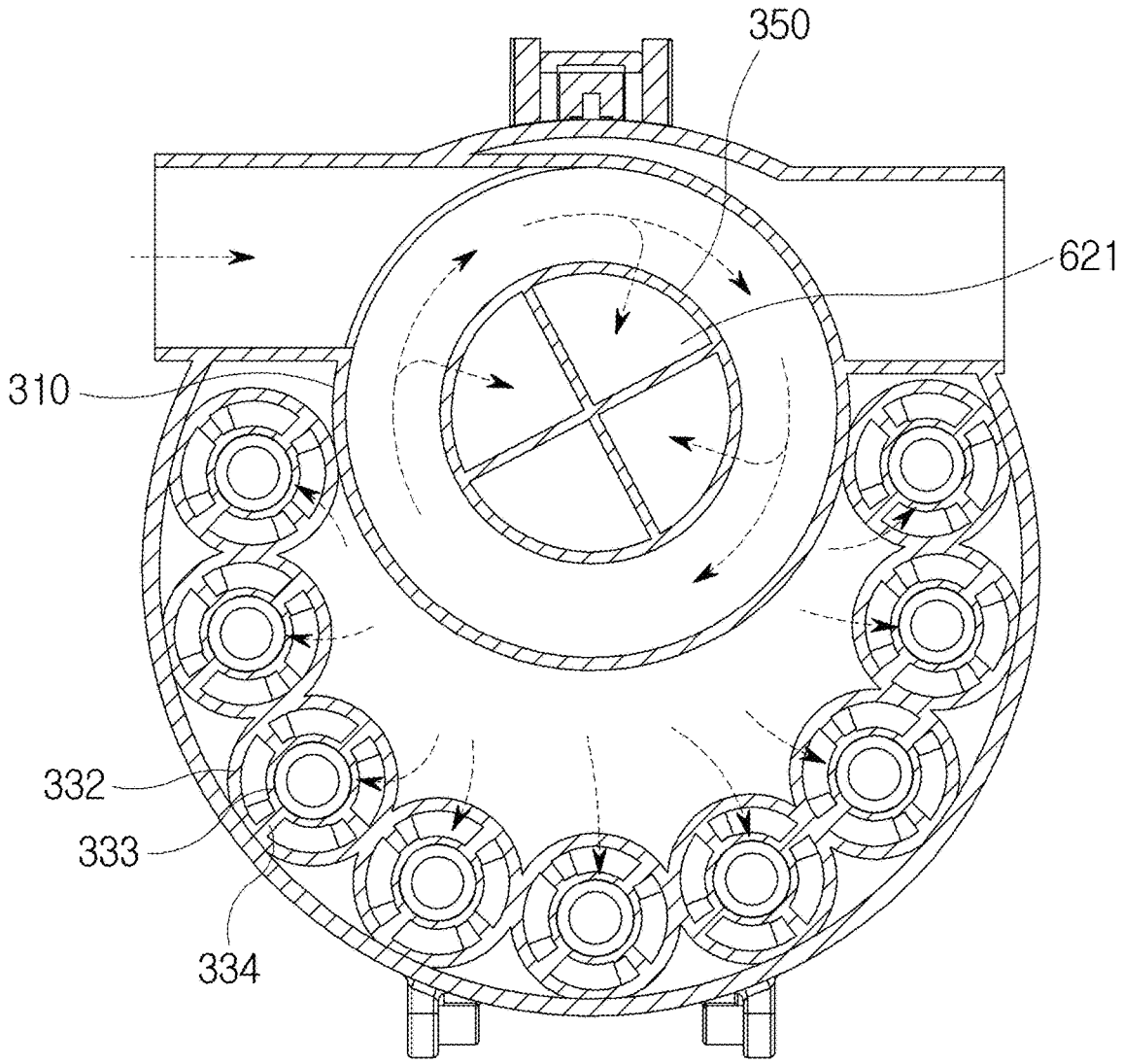
FIG. 6 is a B directional cross-sectional view of the dustbin in FIG. 4.
Figure 7:
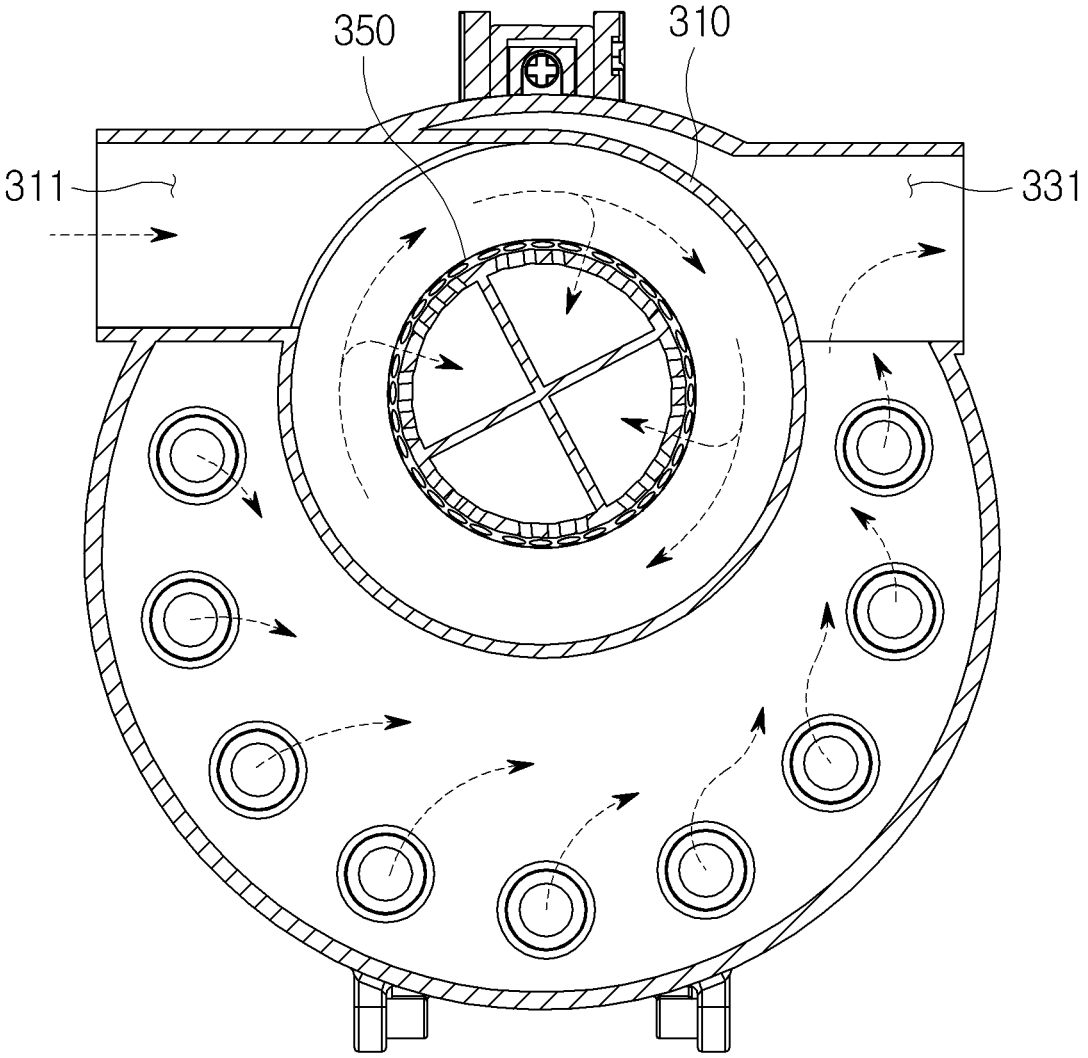
FIG. 7 is a C directional cross-sectional view of the dustbin in FIG. 4.

Referring to FIGS. 4 and 5, the cyclone part 30 further includes the cyclone filter 350 disposed in the communication hole 621. The cyclone filter 350 guides air separated from dust in the first cyclone 310 to the second cyclone 330. The cyclone filter 350 filters out dust while air passes through the cyclone filter 350.

The cyclone filter 350 is disposed between the first cyclone 310 and the second cyclone 330. The cyclone filter 350 is disposed in the communication hole 621.

To this end, the cyclone filter 350 may include a mesh portion having a plurality of holes. The mesh portion is not limited thereto, but may be formed of a metal material.

At least a portion of the cyclone filter 350 protrudes in a direction toward the first dust storage part 630. The cyclone filter 350 may be formed in a cup shape protruding in the direction toward the first dust storage part 630.

In a case in which the cyclone filter 350 protrudes toward the first dust storage part 630, there is a problem that filtered dust accumulates inside the cyclone filter 350. However, even if some dust is settled in the cyclone filter 350 according to the present disclosure due to the protruding of the cyclone filter 350 toward the first dust storage part 630, the dust is scattered again due to air flowing cyclonically, and in the end, no dust is settled in the cyclone filter 350, so the cyclone filter 350 may be maintained to be clean.

Inside the first cyclone 310, air rotates along the circumference of the cyclone filter 350. Some air rotates along the outer circumferential surface of the cyclone filter 350, and the remaining air flows through the cyclone filter 350 to the second dust storage part 640.

The compression member 650 is disposed in the first dust storage part 630 and is a component that compresses large dust settled inside the first dust storage part 630.

Referring to FIGS. 3 and 4, the compression member 650 includes the compression plate 651 disposed in the first cap 632 and configured to reciprocate in the first dust storage part. The compression plate 651 is disposed in the first cap 632. The first cap 632 may have a recessed part formed at a position facing the position of the first opening part 631, and at least a portion of the compression plate 651 is inserted into the recessed part of the first cap 632. The compression plate 651 is installed in the first cap 632 and may be disposed on the first opening part 631 to close the first opening part 631.

The compression plate 651 is formed in the cross-sectional shape of the first dust storage part. When viewed from the right side, the first opening part 631 has a circular cross-section. The compression plate 651 may be formed as a circular plate according to the cross-sectional shape of the first opening part 631. Referring to FIG. 4, the compression plate 651 slides from right to left, and as the compression plate 651 moves, dust is pushed toward the separating wall 620 and compressed.

Referring to FIGS. 3 and 4, the compression member 650 includes a compression plate guide bar 652.

The compression plate guide bar 652 is coupled to one side of the compression plate 651. Referring to FIG. 4, the compression plate guide bar 652 is located on the upper side of the compression plate 651 and extends to the right side. However, the compression plate guide bar 652 is not necessarily limited thereto, and may be coupled to a lower side or another side of the compression plate 651 within a range that can be easily adopted by those skilled in the art.

The compression plate guide bar 652 is formed in the shape of a cantilever.

The compression plate guide bar 652 penetrates the first cap 632. The first cap 632 has a through hole through which the compression plate guide bar 652 is inserted, wherein the compression plate guide bar 652 may move through the through hole.

A first end of the compression plate guide bar 652 is coupled to the compression plate, and a second end of the compression plate guide bar 652 is connected to the lever 660. When the lever 660 is moved in a second direction Y, the compression plate guide bar 652 moves together with the lever 660, and the compression plate is compressed.

Referring to FIGS. 3 and 4, the compression member 650 includes a packing 655. The packing 655 is a component that prevents dust from leaking through a through hole through which the compression plate guide bar 652 passes.

The packing 655 is penetrated by the compression plate guide bar 652.

The packing 655 is disposed on the outer surface of the first cap 632. The first cap 632 has a recessed part formed at a position at which the packing 655 is inserted, and the packing 655 is inserted into the recessed part so that a position thereof can be fixed.

Referring to FIG. 4, the first cap 632 may be configured as a double cover including a first outer cap and a first inner cap. In this case, the packing 655 is disposed on the outer surface of the first inner cap. When the compression plate 651 moves to the left side and performs compressing, internal air may leak through the through hole, and to prevent this, the packing 655 is required to be disposed on the outer surface of the first inner cap. Due to frictional force between the packing 655 and the compression plate guide bar 652, the packing 655 maintains the position thereof, and compressed air is prevented from escaping.

Referring to FIG. 2, the lever 660 selectively opens the first cap 632 or the second cap 642.

The lever 660 includes a first lever 661 which extends toward the first cap 632 and opens the first cap 632, and a second lever 662 which extends toward the second cap 642 and opens the second cap 642. The first lever 661 and the second lever 662 may be integrally formed.

The first cap hook 653 and the second cap hook 6422 are arranged on a straight line with a rail 680. Accordingly, when the lever 660 is moved in a first direction, the holding of the first cap hook 653 is released to open the first cap 632, and when the lever 660 is moved in the second direction Y, the holding of the second cap hook 6422 is released to open the second cap 642.

The first cap hook 653 and the second cap hook 6422 are disposed at opposite sides of the rail 680 relative to the rail 680. Accordingly, the first cap 632 and the second cap 642 are selectively opened, and a user may consecutively remove dust from the first dust storage part and dust from the second dust storage part 640. In addition, when the lever 660 is moved in the second direction Y, the second cap 642 is opened and at the same time, the compression plate 651 is moved to compress dust inside the first dust storage part 630.

The lever 660 opens the first cap 632. When the lever 660 is moved in the first direction X, the first cap 632 is opened. The first direction X is a direction toward the first cap 632 from the lever 660.

Figure 11:
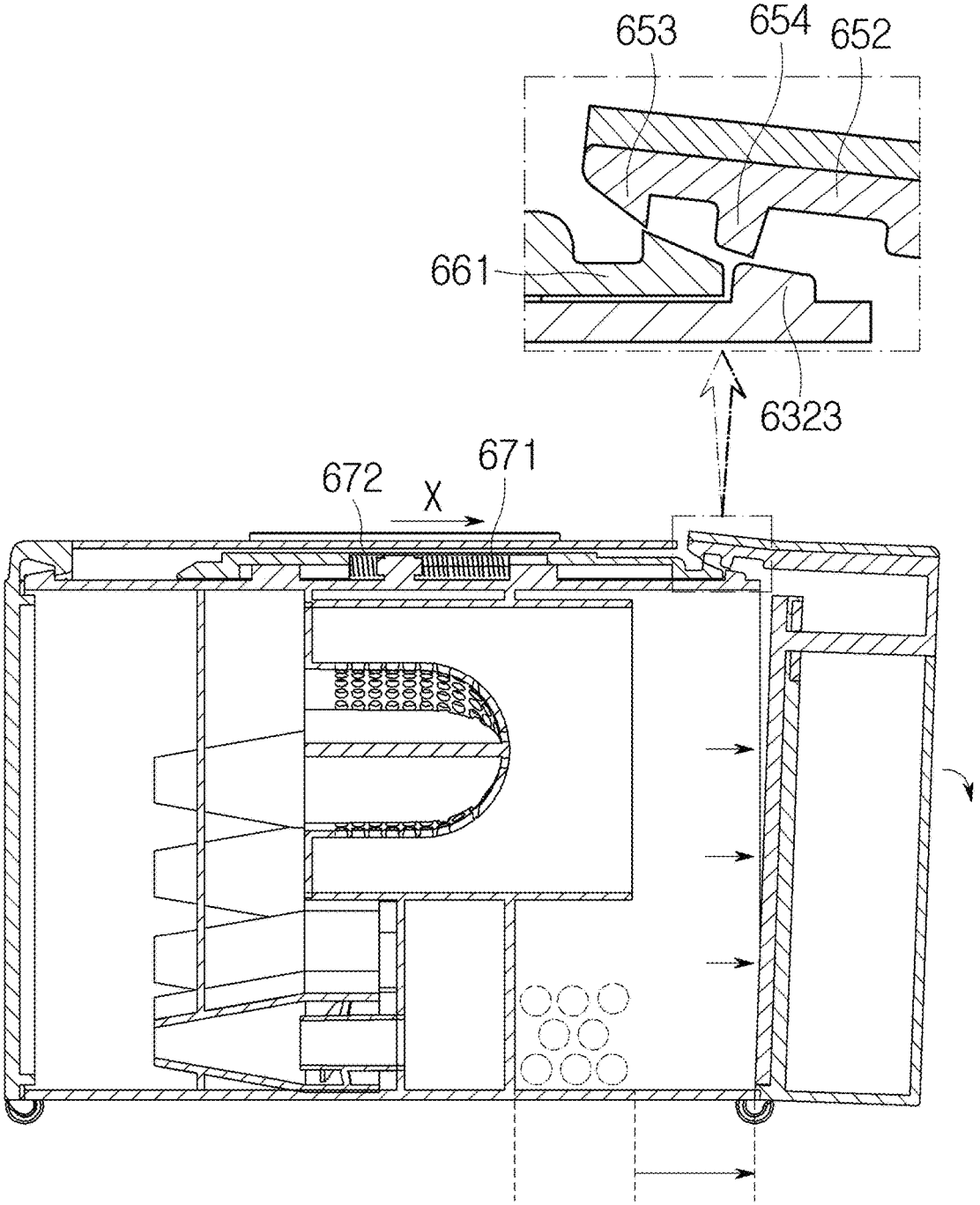
FIG. 11 is a cross-sectional view of the dustbin when a first cap is opened by moving the lever toward the first cap in FIG. 9.
Figure 12:
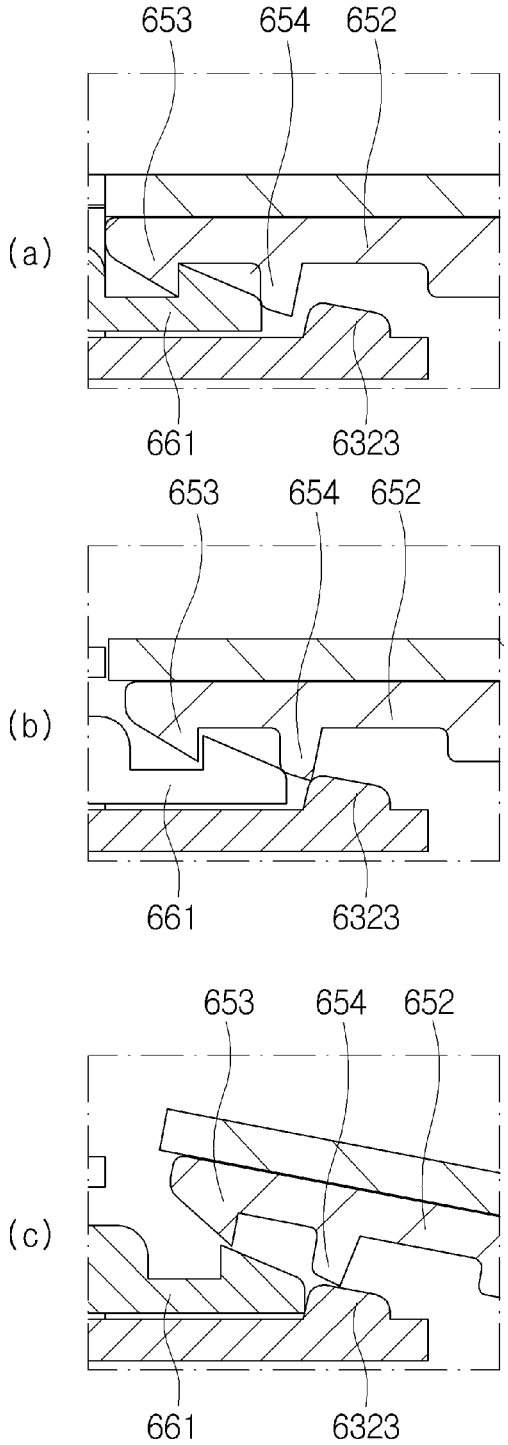
FIGS. 12A, 12B, and 12C are enlarged views of a first cap hook before and after the opening of the first cap in FIG. 11.

FIG. 11 is a cross-sectional view illustrating a state in which the first cap is opened by moving the lever toward the first cap after removing fine dust collected in the second dust storage part in FIG. 9, and FIGS. 12A, 12B, and 12C are enlarged views of a first cap hook before and after the opening of the first cap in FIG. 11. That is, in FIG. 11, the lever is moved in the first direction X and opens the first cap, so dust collected inside the first dust storage part 630 is removed. Referring to FIG. 11, at least a portion of the first cap hook 653 is held by the lever 660. The first cap hook 653 is formed on the end part of the compression plate guide bar 652. The lever 660 has a first lever hook 6611 fastened to the first cap hook 653. The first lever hook 6611 is formed on the end part of the first lever 661.

When the first cap hook 653 is fastened to the first lever hook 6611, the first cap 632 closes the first opening part 631.

The first lever 661 releases the fastening of the first cap hook 653 and the first lever hook 6611.

The compression plate 651 includes a first release protrusion 654 disposed outside the first lever hook 6611 and protruding toward the lever 660. The first release protrusion 654 raises the compression plate guide bar 652. When the compression plate guide bar 652 is raised, the fastening of the first cap hook 653 and the first lever hook 6611 is released.

The first lever 661 and the compression plate guide bar 652 are disposed on a straight line. In more detail, the first lever 661, the first cap hook 653, and the first release protrusion 654 are disposed to overlap vertically.

The right end of the first lever 661 is formed to have an inclined surface inclined upward leftward. Accordingly, the first lever 661 is inserted to a side under the lower end of the first release protrusion 654, and pushes the first release protrusion 654 upward. When the first release protrusion 654 is pushed upward, the first cap hook 653 is also pushed upward, and the fastening of the first cap hook 653 and the first lever 661 is released. Accordingly, the first cap 632 is opened while rotating relative to the first cap hinge 6321.

The lever 660 moves the compression plate 651 to compress dust in the first dust storage part 630.

The end part of the first cyclone 310 is disposed to be spaced apart from the compression plate 651. At least a portion of the first cyclone 310 is disposed through the separating wall 620 and is disposed farther from the compression plate 651. The first cyclone 310 does not exist in the stroke distance of the compression plate 651. For example, even when the lever 660 moves to a critical distance in the second direction Y, the end part of the first cyclone 310 is spaced apart from the compression plate 651.

The lever 660 opens the second cap 642. When the lever 660 is moved in the second direction Y, the second cap 642 is opened. The second direction Y is a direction toward the second cap 642 from the lever 660.

Figure 8:
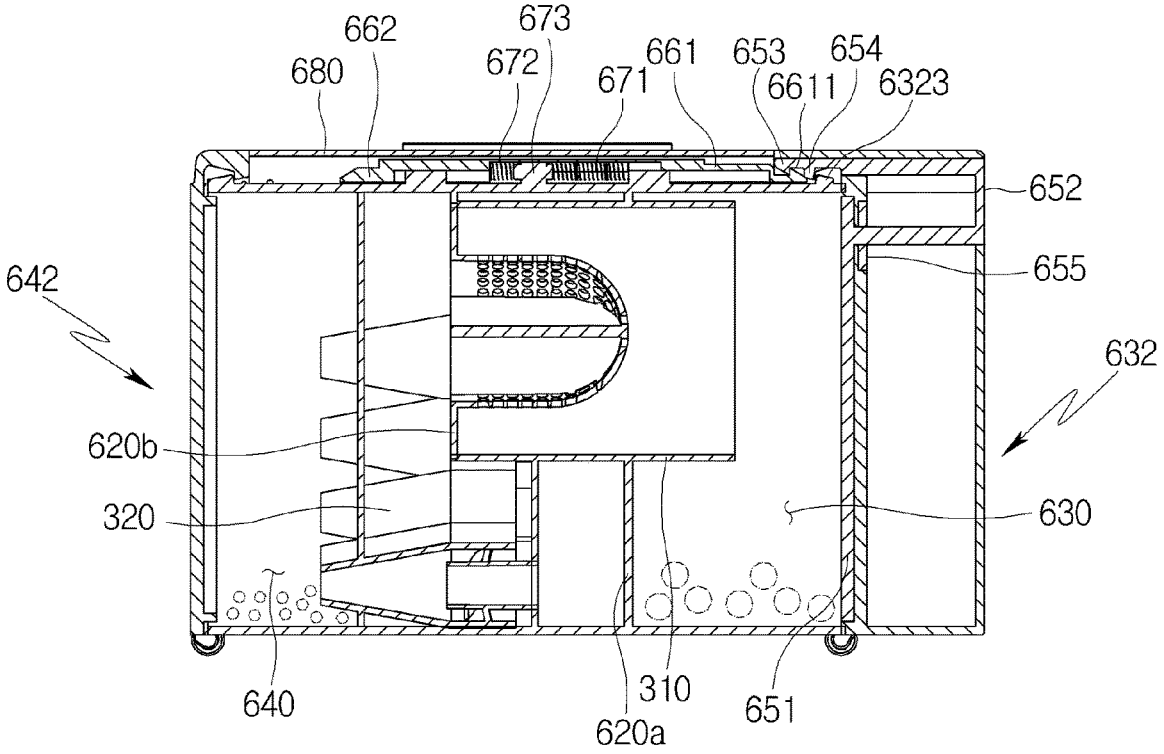
FIG. 8 is a cross-sectional view of the dustbin which collects dust viewed from the front.
Figure 9:
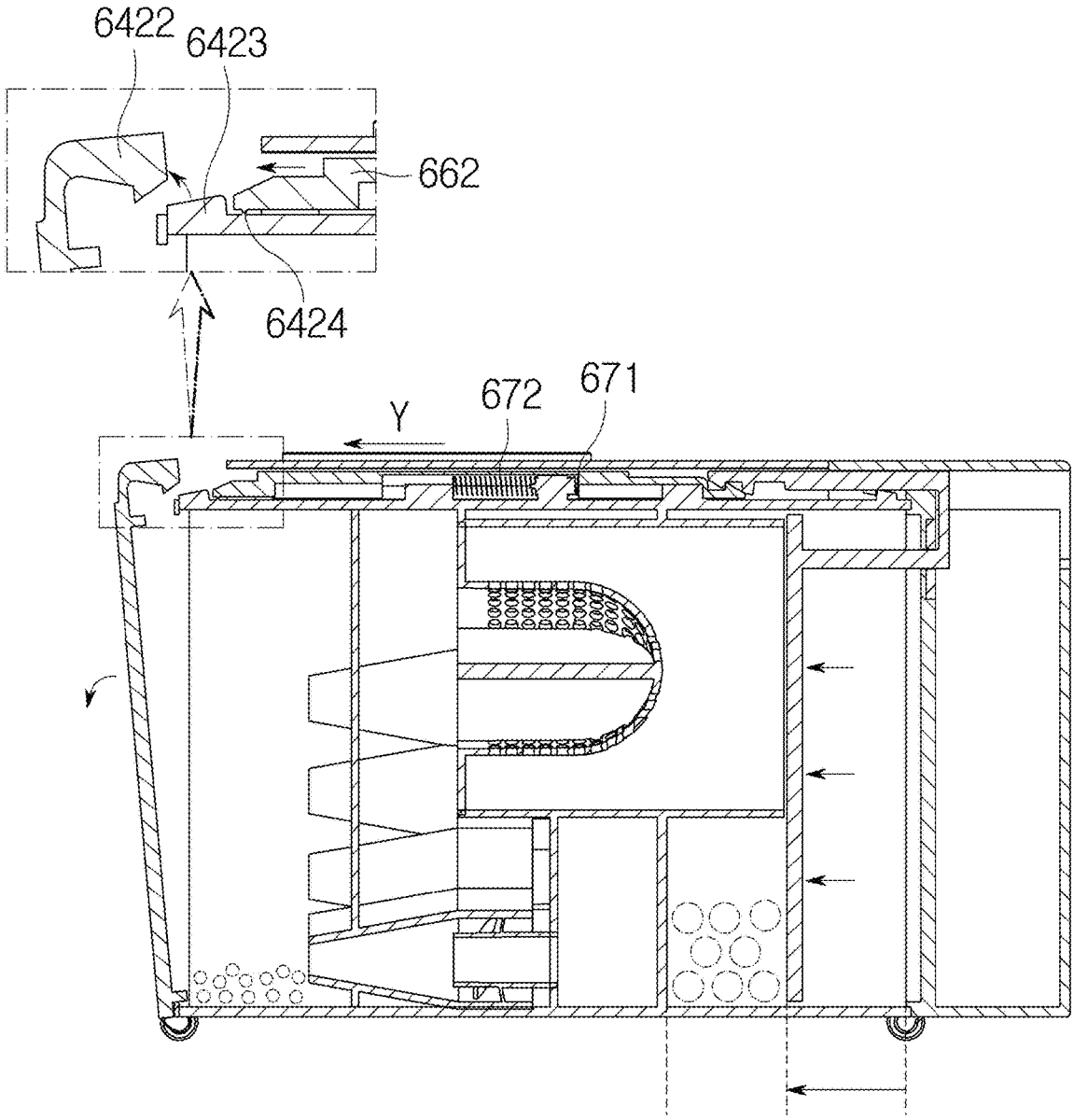
FIG. 9 is a cross-sectional view of the dustbin when a second cap is opened by moving a lever toward the second cap in FIG. 8.

FIG. 8 is a cross-sectional view of the dustbin, in which dust is collected, viewed from the front side after the operation of the cleaner, and FIG. 9 is a cross-sectional view illustrating a state in which a second cap is opened by moving the lever toward the second cap in FIG. 8, and FIGS. 10A, 10B, and 10C are enlarged views of the second cap hook before and after the opening of the second cap in FIG. 9. That is, in FIG. 9, by moving the lever in the second direction Y, fine dust collected inside the second dust storage part 640 is removed, and, at the same time, large dust collected inside the first dust storage part 630 is compressed.

Referring to FIG. 9, the second cap hook 6422 is fastened to the casing 610, and the casing 610 includes the second cap protrusion 6423 formed on one side of the outer circumferential surface thereof and holding the second cap hook 6422.

The second cap hook 6422 is formed on the upper end of the second cap 642. The second cap protrusion 6423 is formed on the upper end part of the casing 610 by protruding therefrom. The second cap hook 6422 is fastened to the second cap protrusion 6423. When the second cap hook 6422 is fastened to the second cap protrusion 6423, the second cap 642 closes the second opening part 641.

The second lever 662 releases the fastening of the second cap hook 6422 and the second cap protrusion 6423.

The second lever 662, the second cap hook 6422, and the second cap protrusion 6423 are disposed on a straight line. The left end of the second lever 662 has an inclined surface inclined upward rightward. The second cap hook 6422 has an inclined surface inclined upward rightward to correspond to the inclined surface of the second lever 662. Accordingly, the second lever 662 is inserted to a side under the lower end of the second cap hook 6422 and pushes the second cap hook 6422 upward. When the second lever 662 moves to a critical stroke distance of the left side, the fastening of the second cap hook 6422 is released, and the second cap 642 is opened while rotating relative to the second cap hinge 6421.

The casing 610 further includes the second release protrusion 6424 disposed between the second cap protrusion 6423 and the lever 660 and protruding upward from the casing 610. When the second lever 662 is moved in the second direction Y, the lower surface of the second lever 662 slides on the upper end of the second release protrusion 6424. The second release protrusion 6424 pushes the second lever 662 upward. Accordingly, the second cap hook 6422 is pushed more upward and the fastening thereof may be more easily released.

The lever 660 covers at least a portion of the rail 680.

The rail 680 protrudes outward from the outer circumferential surface of the casing 610 and extends toward at least one of the first opening part 631 and the second opening part 641. Referring to FIG. 2, the rail 680 protrudes from the top of the casing 610 and extends to left and right sides.

When the lever 660 is moved in one direction, the inner space of the first dust storage part 630 is reduced, and the second dust storage part 640 is opened. For example, when the lever 660 is moved in the second direction Y, the compression plate 651 is moved in the second direction Y, and thus the inner space of the first dust storage part 630 is reduced and dust of the first dust storage part 630 is compressed. When the lever 660 moves to the critical distance in the second direction Y, the fastening of the second cap hook 6422 is released, and the second dust storage part 640 is opened.

An elastic member support protrusion 673 protrudes in the inner space of the rail 680. The elastic member support protrusion 673 supports an elastic member 670. A first elastic member 671 is supported by a first side of the elastic member support protrusion 673, and a second elastic member 672 is supported by a second side of the elastic member support protrusion 673.

The elastic member 670 is disposed between the rail 680 and the lever 660.

When the lever 660 is moved in the second direction Y, the first elastic member 671 provides restoring force thereto. The first end of the first elastic member 671 is supported by the elastic member support protrusion 673, and the second end of the first elastic member 671 supports the first lever 661.

When the lever 660 is moved in the first direction X, the second elastic member 672 provides restoring force thereto. The first end of the second elastic member 672 is supported by the elastic member support protrusion 673, and the second end of the second elastic member 672 supports the second lever 662. When the lever 660 moves in the first direction X, the first elastic member 671 is stretched and the second elastic member 672 is compressed. Accordingly, the lever 660 is restored to an initial position thereof by the second elastic member 672. Conversely, when the lever 660 moves in the second direction Y, the first elastic member 671 is compressed and the second elastic member 672 is stretched. Accordingly, the lever 660 is restored to the initial position by the first elastic member 671.

The handle 40 is a component that allows a user to grip and move the cleaner 1 and is disposed at a side opposite to the suction part 10 relative to the cyclone part 30, and may include a gripping part 450, which is a part gripped by a user's hand. Here, the gripping part 450 has an approximately cylindrical shape and has the longitudinal axis A4. In addition, the gripping part 450 may be disposed in a form in which an upper portion thereof is inclined toward the front side.

The power supply part 50 is a component for supplying power to the motor part 20 and includes a battery 510. The power supply part 50 may be disposed to be adjacent to the handle 40 at an upper side thereof and may be disposed to be adjacent to a lower portion of the outer circumferential surface of the dustbin 60 to be described later at a front side thereof.

A filter (not shown) is a component disposed on an air flow path to filter dust included in air. A filter (not shown) installed in the cleaner 1 according to the present disclosure includes a pre-filter and a HEPA filter The pre-filter may be a mesh filter having a cylindrical shape. For example, the pre-filter may include materials such as nylon and spun-bonded fabric. The spun-bonded fabric is a type of non-woven fabric made by spinning synthetic fibers such as polypropylene (PP) and then applying heat to the fibers to bond the fibers together.

The HEPA filter (not shown) functions to finally filter fine dust that is not filtered out by the pre-filter and may be accommodated inside the housing 3.

In the present disclosure, it has been described that the cleaner 1 includes the pre-filter and the HEPA filter, but it should be noted that the type and number of filters are not limited.

Hereinafter, the operation and effects of the cleaner 1 according to the present disclosure described above will be described.

Referring to FIGS. 2, and 4 to 7, air sucked by the suction part 10 flows in the cyclone part 30, and dust is separated from the air.

Referring to FIG. 5, air is supplied from the inlet 311 to the first cyclone 310. The first cyclone 310 generates a cyclonic flow of air. In the first cyclone 310, air is primarily separated from large dust and flows through the cyclone filter 350 to the second cyclone 330. The large dust separated in the first cyclone 310 accumulates on the bottom of the first cyclone 310 or the bottom of the first dust storage part 630.

The second cyclone 330 generates a cyclonic flow of air. In the second cyclone 330, air is secondarily separated from fine dust and discharged through the outlet 331. The fine dust separated in the second cyclone 330 accumulates on the bottom of the second cyclone 330 or the bottom of the second dust storage part 640.

Relatively large dust accumulates on the bottom of the first dust storage part 630, and relatively fine dust accumulates on the bottom of the second dust storage part 640. Since large dust and fine dust accumulate in spaces spaced apart from each other, the large dust and the fine dust may be handled separately.

Figure 10:
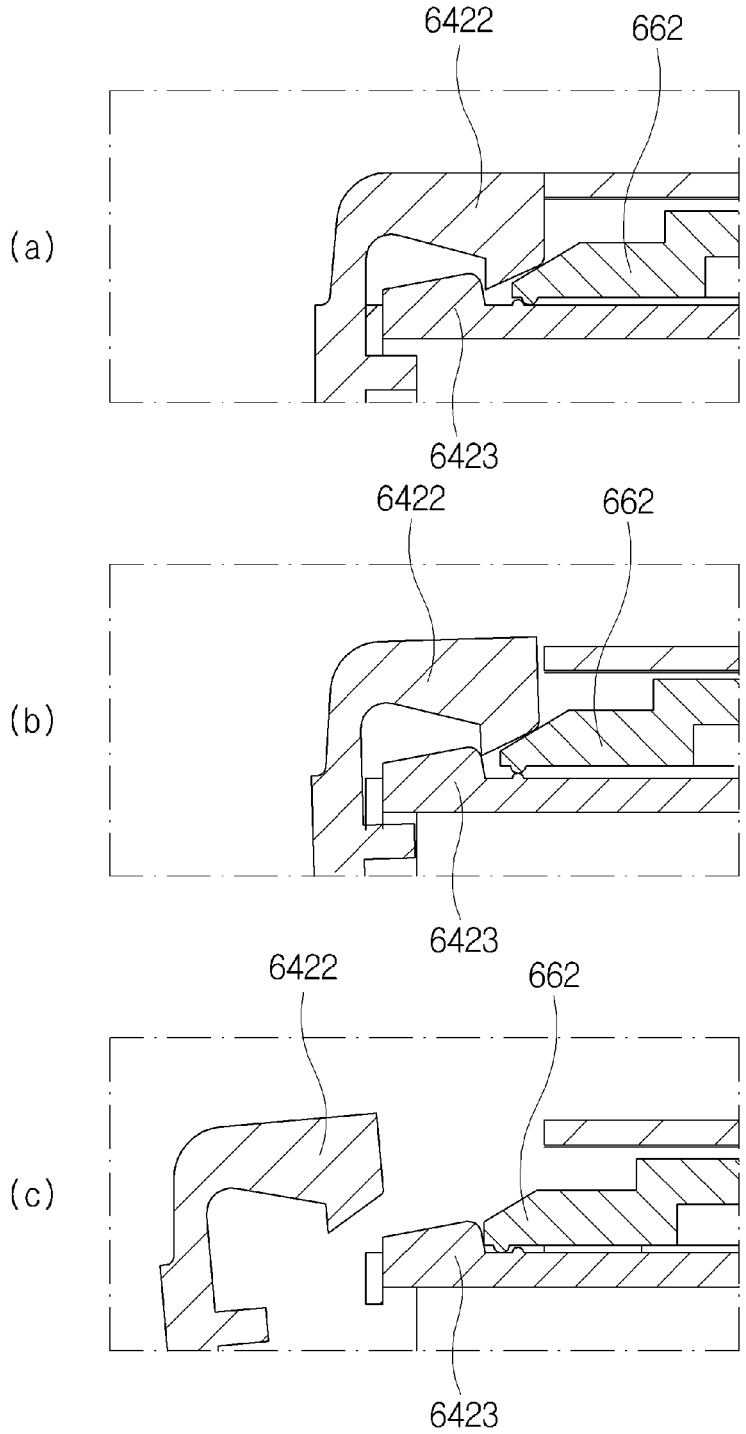
FIGS. 10A, 10B, and 10C are enlarged views of a second cap hook before and after the opening of the second cap in FIG. 9.

Referring to FIGS. 9 and 10, the lever may move to the second direction Y to discard fine dust collected inside the second dust storage part 640. In more detail, the lever moves in the second direction Y to open the second cap so that fine dust collected inside the second dust storage part 640 is discarded, and at the same time, the compression plate may be moved so that large dust connected inside the first dust storage part 630 can be compressed.

The lever is connected to the compression plate, and when the lever is moved in the second direction Y, the compression plate reduces the volume of the first dust storage part 630 and compresses large dust collected in the first dust storage part 630. When the lever is further moved in the second direction Y, the end part of the second lever of the lever raises the second cap hook 6422 to release the fastening of the second cap, and the second cap is opened, so fine dust inside the second dust storage part 640 can be discarded.

Referring to FIGS. 10A, 10B, 10C, 11, 12A, 12B, and 12C, the lever can move in the first direction X and discard large dust collected and compressed inside the first dust storage part 630. The lever moves to the first direction X, disconnects from the compression plate, and at the same time, opens the first cap, so that large dust collected inside the first dust storage parts 630 can be discarded. When the lever moves in the first direction X, the end part of the first lever of the lever raises the first release protrusion 654. When the first release protrusion 654 is raised, the first cap hook 653 is also raised, and the fastening of the first cap hook and the lever is released, so the first cap is opened.

Although the specific embodiment of the present disclosure has been described and shown, the present disclosure is not limited to the described embodiment, and it will be appreciated that those skilled in the art may variously modify and transform the embodiment to other specific embodiments without departing from the spirit and scope of the present disclosure. Accordingly, the scope of the present disclosure should not be determined by the described embodiment, but should be determined by the technical ideas described in the claims.

The invention claimed is:

1. A cleaner comprising:

a dustbin having an inlet formed on a first side thereof and an outlet formed on a second side thereof, the dustbin being provided with a cyclone part generating a cyclonic flow inside the cyclone part; and a motor part including a suction motor configured to communicate with the dustbin and generate a flow of air inside the dustbin, wherein the dustbin comprises:

a casing having the inlet and the outlet formed thereon;

a separating wall dividing an inner space of the casing;

a first dust storage part located in the inner space and communicating with the inlet, with a first opening part formed on one side of the first dust storage part;

a first cap configured to cover the first opening part;

a second dust storage part located in the inner space and communicating with the outlet, with a second opening part formed on one side of the second dust storage part;

a second cap configured to cover the second opening part;

a lever configured to selectively open the first cap or the second cap; and a compression plate comprising a first cap hook, wherein at least a portion of the first cap hook is held by the lever.

2. The cleaner of claim 1, wherein the first opening part is formed on a first side of the casing, and the second opening part is formed on a second side of the casing and faces the first opening part.

3. The cleaner of claim 1, wherein at least any one of the first cap and the second cap comprises a hinge connected to the casing at a first end thereof.

4. The cleaner of claim 3, wherein the first cap comprises the first cap hook is configured to be fastened to the casing, wherein the second cap comprises a second cap hook configured to be fastened to the casing, and wherein the first cap hook and the second cap hook are arranged on a straight line with a rail.

5. The cleaner of claim 4, wherein the first cap hook and the second cap hook are disposed at opposite sides of the rail relative to the rail.

6. The cleaner of claim 3, wherein the second cap comprises a second cap hook configured to be fastened to the casing, and the casing comprises a second cap protrusion formed on one side of an outer circumferential surface thereof and configured to hold the second cap hook.

7. The cleaner of claim 6, wherein the casing further comprises a second release protrusion which is disposed between the second cap protrusion and the lever and protrudes upward.

8. The cleaner of claim 1, comprising:

a second elastic member which provides a restoring force to the lever when the lever moves in a first direction; and a first elastic member which provides a restoring force to the lever when the lever moves in a second direction.

9. The cleaner of claim 8, wherein the lever has an inner space, and the casing comprises an elastic member support protrusion protruding to the inner space of the lever, wherein the first elastic member is supported by a first side of the elastic member support protrusion, and the second elastic member is supported by a second side of the elastic member support protrusion.

10. The cleaner of claim 1, wherein the compression plate is disposed in the first cap and configured to reciprocate in the first dust storage part.

11. The cleaner of claim 1, wherein the compression plate comprises a first release protrusion disposed outside a first lever hook and protruding toward the lever.

12. The cleaner of claim 1, wherein the cyclone part comprises a first cyclone disposed in the first dust storage part, wherein an end part of the first cyclone is disposed to be spaced apart from the compression plate.

13. The cleaner of claim 1, wherein the cyclone part comprises a first cyclone disposed in the first dust storage part such that at least a portion of the first cyclone penetrates the separating wall.

14. The cleaner of claim 1, comprising:

a rail protruding outward from an outer circumferential surface of the casing and extending toward at least any one of the first opening part and the second opening part, with at least a portion of the rail covered by the lever.

15. The cleaner of claim 14, wherein when the lever moves in one direction, an inner space of the first dust storage part decreases, and the second dust storage part is opened.

* * * * *